US011054196B2

(12) United States Patent
Manenti

(10) Patent No.: US 11,054,196 B2
(45) Date of Patent: Jul. 6, 2021

(54) SHELL-AND-TUBE HEAT EXCHANGER

(71) Applicant: ALFA LAVAL OLMI S.P.A, Suisio (IT)

(72) Inventor: Giovanni Manenti, Castelli Calepio (IT)

(73) Assignee: ALFA LAVAL OLMI S.P.A., Suisio (IT)

( * ) Notice: Subject to any disclaimer, the term of this patent is extended or adjusted under 35 U.S.C. 154(b) by 50 days.

(21) Appl. No.: 16/616,674

(22) PCT Filed: Apr. 26, 2018

(86) PCT No.: PCT/EP2018/060722
§ 371 (c)(1),
(2) Date: Nov. 25, 2019

(87) PCT Pub. No.: WO2018/215160
PCT Pub. Date: Nov. 29, 2018

(65) Prior Publication Data

US 2021/0148652 A1 May 20, 2021

(30) Foreign Application Priority Data

May 26, 2017 (EP) ..... 17425056

(51) Int. Cl.
*F28F 9/02* (2006.01)
*F28D 7/06* (2006.01)
*F28F 9/22* (2006.01)

(52) U.S. Cl.
CPC ..... *F28F 9/0202* (2013.01); *F28D 7/06* (2013.01); *F28F 2009/224* (2013.01); *F28F 2250/102* (2013.01); *F28F 2270/00* (2013.01)

(58) Field of Classification Search
CPC ..... F28F 9/0202; F28F 2009/224; F28F 2250/102; F28F 2270/00; F28D 7/06
(Continued)

(56) References Cited

U.S. PATENT DOCUMENTS 2,774,575 A 12/1956 Hellmuth
2,800,307 A 7/1957 Putney
(Continued)

FOREIGN PATENT DOCUMENTS

CN 206177089 U 5/2017
DE 24 27 303 A1 12/1975
(Continued)

OTHER PUBLICATIONS

An English Translation of the Office Action (Decision to Grant) and Search Report dated Apr. 21, 2020, by the Federal Service for Intellectual Property (Rospatent) in corresponding Russian Patent Application No. 2019143679/06(084624). (9 pages).
(Continued)

*Primary Examiner* — Davis D Hwu
(74) *Attorney, Agent, or Firm* — Buchanan Ingersoll & Rooney PC

(57) ABSTRACT

A shell-and-tube heat exchanger has a cylindrical geometry and comprises a first pressure chamber and a second pressure chamber connected to a common tube-sheet on opposite sides. The tube-sheet is connected to a tube bundle housed in the first pressure chamber and comprising a plurality of U-shaped exchanging tubes. Each U-shaped tube is provided with a first portion and with a second portion. The first pressure chamber contains at least one inner guiding jacket having a cylindrical or pseudo-cylindrical geometry and extending along the major longitudinal axis of the first pressure chamber. The inner guiding jacket surrounds the first portion of each U-shaped tube for at least part of the respective length. The inner guiding jacket is sealingly connected, at a first end thereof, to the tube-sheet. The inner guiding jacket is open at a second end thereof.

15 Claims, 9 Drawing Sheets

(58) Field of Classification Search
USPC ..... 165/158
See application file for complete search history.

(56) References Cited

U.S. PATENT DOCUMENTS

| | | | | |
|---|---|---|---|---|
| 3,168,136 | A | 2/1965 | Ammon | |
| 3,187,807 | A | 6/1965 | Ammon | |
| 3,437,077 | A | 4/1969 | Ammon et al. | |
| 3,545,536 | A | 12/1970 | Peters et al. | |
| 3,575,236 | A * | 4/1971 | Romanos | F22B 37/206 165/162 |
| 3,749,160 | A | 7/1973 | Vestre | |
| 4,142,580 | A | 3/1979 | Bailey | |
| 4,180,017 | A | 12/1979 | Drobka | |
| 4,220,200 | A | 9/1980 | Weber | |
| 4,287,944 | A | 9/1981 | Becker | |
| 4,431,049 | A | 2/1984 | Zamma et al. | |
| 4,548,257 | A | 10/1985 | Williamson | |
| 4,561,496 | A | 12/1985 | Kehrer | |
| 4,576,225 | A | 3/1986 | Nassauer | |
| 4,907,643 | A | 3/1990 | Grotz et al. | |
| 4,972,903 | A * | 11/1990 | Kwok | F28D 7/06 165/158 |
| 5,296,199 | A * | 3/1994 | Kwok | B01J 19/0013 422/187 |
| 5,915,465 | A | 6/1999 | Fix et al. | |
| 8,261,700 | B2 | 9/2012 | Stahl et al. | |
| 9,227,844 | B2 | 1/2016 | Han et al. | |
| 2003/0226654 | A1 | 12/2003 | Gohna | |
| 2009/0218081 | A1 | 9/2009 | Mathew et al. | |
| 2011/0104037 | A1 | 5/2011 | Stahl et al. | |
| 2012/0277327 | A1 | 11/2012 | Han et al. | |
| 2016/0097375 | A1 | 4/2016 | Zanardi | |
| 2016/0334175 | A1 | 11/2016 | Eckert et al. | |

FOREIGN PATENT DOCUMENTS

| | | | |
|---|---|---|---|
| DE | 33 33 735 | A1 | 4/1985 |
| DE | 102015212433 | A1 | 1/2017 |
| EP | 0130404 | A2 | 1/1985 |
| EP | 0 274 006 | A1 | 7/1988 |
| EP | 0446392 | A1 | 9/1991 |
| EP | 0860673 | A2 | 8/1998 |
| EP | 0864830 | A1 | 9/1998 |
| EP | 1610081 | A1 | 12/2005 |
| EP | 1059486 | B1 | 7/2006 |
| EP | 2482020 | A2 | 8/2012 |
| GB | 2089951 | A | 6/1982 |
| GB | 2134240 | A | 8/1984 |
| JP | S60-026296 | A | 2/1985 |
| JP | S60-038587 | A | 2/1985 |
| JP | H10-300370 | A | 11/1998 |
| NL | 7009885 | A | 1/1971 |
| RU | 2 263 864 | C2 | 11/2005 |
| RU | 2 490 577 | C2 | 8/2013 |
| WO | 2005010450 | A1 | 2/2005 |
| WO | 2014191937 | A1 | 12/2014 |
| WO | 2015/114105 | A2 | 8/2015 |
| WO | 2017001147 | A1 | 1/2017 |

OTHER PUBLICATIONS

An English Translation of the Office Action (Notice of Preliminary Rejection) dated Jan. 18, 2021, by the Korean Intellectual Property Office in corresponding Korean Patent Application No. 10-2019-7038181. (5 pages)

ARVOS Brochure, Syngas Cooler Systems for Gasification Plant, Schmidtsche Schack, 20 pages, 2015

International Search Report (PCT/ISA/210) dated Jul. 5, 2018, by the European Patent Office as the International Searching Authority for International Application No. PCT/EP2018/060722.

Written Opinion (PCT/ISA/237) dated Jul. 5, 2018, by the European Patent Office as the International Searching Authority for International Application No. PCT/EP2018/060722.

Office Action (Examination Report) dated Nov. 5, 2020, by the Intellectual Property India in corresponding India Patent Application No. 201917053555 and an English Translation of the Office Action. (6 pages).

An English Translation of the First Office Action dated Oct. 10, 2020, by the National Intellectual Property Administration, P. R. China in corresponding Chinese Patent Application No. 201880050188.7. (7 pages).

* cited by examiner

SHELL-AND-TUBE HEAT EXCHANGER

BACKGROUND OF THE INVENTION

The present invention refers to a shell-and-tube heat exchanger and, more specifically, to a shell-and-tube heat exchanger designed to operate with hot process gases. Such a heat exchanger is designed for cooling a hot medium either by a vaporizing cooling medium or by a non-vaporizing cooling medium with a temperature cross with regard to the hot medium.

In process and power industry, process and working media discharged at high temperature and pressure from chemical reactors, furnaces or heat exchangers must often be cooled by means of specifically designed heat exchangers. These heat exchangers are characterized by special heat exchange configurations and technological design.

Hot medium discharged from chemical reactors operating in processes like steam methane reforming, ammonia synthesis, coal/biomass gasification, sulphur burning and ammonia oxidation is a major example of a medium at high temperature and pressure which must be cooled down in a special heat exchanger. Hot medium temperature and pressure can approximately range from 400° C. to 1000° C. and from 0.3 MPa to 30 MPa, respectively. Moreover, the hot medium can harm common construction metallic materials due to some aggressive chemical species like hydrogen, nitrogen, ammonia, carbon monoxide and sulphur oxides.

Due to high temperatures and large flow rates of the hot medium, a wide range of heat removal, from few to tens of megawatt, is usually necessary. In order to perform such a strong cooling, special heat exchangers for the indirect heat exchange between the hot medium and a cooling medium are used.

Such heat exchangers get several common names depending on the industrial process and cooling medium. For instance, a non-exhaustive list of more common heat exchangers used for cooling a hot medium comprises:

- process boilers or waste heat boilers in case the cooling medium is vaporizing water;
- boiler water pre-heaters in case the cooling medium is sub-cooled boiler water;
- steam super-heaters in case the cooling medium is steam;
- synthesis loop boilers in case the hot medium is discharged from an ammonia converter reactor and is cooled by vaporising water;
- vapour generators or evaporators in case of a vaporizing cooling fluid;
- process coolers in case of a generic cooling medium.

Heat exchangers for cooling hot media are frequently of shell-and-tube type, with the hot medium flowing either on the shell-side or the tube-side, with vertical or horizontal installation. Exchanging tubes can be of different type, like straight tubes, U-shaped tubes or coiled tubes. The hot medium and the cooling medium can be indirectly contacted according to different configurations, like co-current flows, counter-current flows and cross-flow, and according to one pass or multi-passes.

Many shell-and-tube type heat exchangers for cooling a medium at high temperature and pressure are known in the state of the art. Some examples of these shell-and-tube type heat exchangers, with specific reference to a process gas, are listed hereinafter.

Document U.S. Pat. No. 4,287,944 describes a vertical process gas boiler wherein a hot process gas flowing on the shell-side indirectly exchanges heat with vaporising water flowing on tube-side and circulating under natural draft. The exchanger is one pass on shell-side and two passes on tube-side. The exchanger housing or shell is internally lined by an insulating material for protecting the shell walls from overheating. The tube bundle consists of U-tubes connected to a common tube-sheet, which separates the exchanger shell from the water-plenum. The water-plenum is split into two chambers, one collecting the water-and-steam mixture from the tube bundle and the other releasing fresh water to the tube bundle. The descending leg of the U-tubes is provided with an inner tube that is in communication with the chamber of fresh water. The inner tube ends shortly before the U-bends with an open end. Such an inner tube feeds the tube bundle with fresh water.

This configuration is claimed to be effective to prevent disturbances on natural circulation, since the vaporization of water in the descending leg occurs in the annulus between the U-tube and the inner tube, and not in the inner tube. Therefore, the steam produced in the annulus is claimed to be discharged into the water-and-steam chamber rather than be dragged into the U-tubes. On the other hand, this configuration is characterized by two potential drawbacks. Firstly, fresh water from the inner tube can be drafted-up in the annulus rather than to proceed in the U-tubes. Secondly, U-tubes have an intermediate welding.

Document U.S. Pat. No. 4,010,797 describes a heat exchanger wherein the shell encloses a tube bundle, preferably with U-shaped tubes, and a shroud which forms, together with the shell, an annular gap and which surrounds most portion of the tube bundle. A hot process gas flows on shell-side and the cooling medium, preferably steam or water, flows on tube-side. A hot gas inlet nozzle is installed far from the tube-sheet and is in communication with the tube bundle. The hot gas firstly flows across the tube bundle in one-pass and then, after cooling, exits from the tube bundle and flows back in the gap. Accordingly, the tube-sheet and the shell are not in contact with the inlet hot gas. However, the exchanger is not capable of handling a temperature cross between the two media, or is not suitable for vaporizing water under natural circulation.

Document EP 2482020 describes a heat exchanger, particularly designed for cooling a process gas, with the hot medium on tube-side and the cooling medium on shell-side. The exchanger has U-shaped tubes, with inner tubes installed in the U-shaped tube legs inletting the hot medium for a partial length of the leg. The exchanger design is claimed to keep the tube-sheet at moderate operating temperature.

Document U.S. Pat. No. 4,561,496 describes a process gas heat exchanger wherein a hot gas flowing on tube-side is cooled through vaporizing water circulating on shell-side. The shell is split into two chambers by internal walls. One chamber contains vaporizing water and the other chamber contains sub-cooled water. As a consequence, on the shell-side, two different cooling streams cross the tube bundle. The internal walls split the shell so as to surround one set of legs of the U-shaped tubes. The surrounded set of legs indirectly exchanges heat from hot gas to sub-cooled water, whereas the remaining portion of tubes indirectly exchange heat from hot gas to vaporising water.

Document U.S. Pat. No. 4,907,643 describes a process gas steam super-heater with U-shaped tubes, wherein the hot process gas flows on shell-side and the cold steam flows on tube-side. The shell-side is provided with a guiding jacket (shroud) which extends most of the tube bundle and forms a gap in between shell and shroud, so as to keep the shell swept by the cooled gas which exits from the shroud. The exchanger has one heat exchange pass on shell-side and two heat exchange passes on tube-side. The exchanger can properly work if there is no temperature cross between the cold and hot media.

Document U.S. Pat. No. 5,915,465 describes a process gas steam super-heater wherein hot process gas and cold steam flow on shell-side and tube-side respectively. The tube bundle consists of U-shaped tubes and the heat exchange is obtained with two passes on both shell-side and tube-side. By means of internal guiding jackets conveying the hot gas along a tortuous path, the two media are indirectly contacted in pure counter-current or pure co-current configuration. The cooled gas sweeps the shell before leaving the exchanger; yet, a portion of the tube-sheet is exposed to the inlet hot gas.

Document WO 2017/001147 describes a process gas heat exchanger wherein the hot process gas flows on shell-side and the cooling medium flows on tube-side. The shell is internally equipped with a guiding jacket, surrounding most length of the tube bundle, which forms a gap in between the shell and the jacket. In such gap, the cooled gas is conveyed after the cooling. The tube bundle consists of tubes of bayonet type.

Document EP 1610081 describes a heat exchanger, particularly designed for cooling a process gas by steam superheating, wherein the hot medium flows on tube-side and the cooling medium flows on shell-side. The exchanger has two concentric tube bundles, consisting of U-shaped tubes, made by different materials. On the shell-side, guiding jackets define two partially separated areas, wherein one area works at high temperature and relevant to one of the two tube bundles, and the other area works at low temperature and relevant to the other tube bundle. The exchanger is two-passes on shell-side and four-passes on tube-side. The exchanger may be not suitable in case the two media have a temperature cross and the inlet hot medium is in contact with the tubesheet.

Document U.S. Pat. No. 3,749,160 describes a heat exchanger for heat treatment of gas, wherein the gas to be treated can flow either on tube-side or on shell-side. The exchanger has U-shaped tubes and a mantle, installed internally to the shell, that surrounds most length of the tube bundle and that forms an annular gap with the shell. The mantle has both ends open. The shell-side gas enters into the mantle approximately at the mid length of the tube bundle and splits into two portions which cross the tube bundle in opposite directions. The two portions exit from the two ends of the shell and flow in the gap towards the outlet shell-side nozzle. When the shell-side gas is the hotter one and must be cooled, the shell is therefore swept by the cooled gas. The exchanger has one heat exchange pass on shell-side and two heat exchange passes on tube-side. The exchanger may not properly work if the two media have a temperature cross.

Other relevant heat exchangers, particularly suitable for cooling a hot liquid metal or a hot fluid coming from a nuclear reactor, are described in open literature. For example, document U.S. Pat. No. 3,187,807 describes a vertical heat exchanger mainly comprising a pressure vessel, a two-passes tube bundle, two separated tube-sheets for each tube-pass, installed in the upper part of the vessel, and two baffles, extending along the tubes and concentrically arranged, forming an inner and an outer chamber so that the first and the second tube-passes are positioned into the inner and the outer chambers respectively. The hot medium flows on the outer chamber side and the cooling medium flows on tube-side. Since the hot medium inlet is located in the upper part of the vessel, the heat transfer from hot and to cold media occurs via counter-flow or cross-flow. With such a configuration, the tube-sheet of the second tube-pass and an upper part of the vessel are in contact with the inlet hot medium, which can lead to a problematic design in case of high inlet temperatures.

Document U.S. Pat. No. 3,545,536 describes a shell-and-tube heat exchanger with U-shaped tubes, wherein the hot and cooling media flow on shell-side and tube-side respectively. The exchanger is two-passes both on tube-side and shell-side by means of a baffle installed in the shell forming two sections, one for the first tube-pass and the other for the second tube-pass. The heat transfer from shell-side to tube-side occurs via co-current flow. Document U.S. Pat. No. 3,545,536 focuses on a device for protecting the inlet portion of the first tube-pass from overheating or high heat flux due to the perpendicular impingement of the shell-side inlet medium on tubes. The device mainly consists of a collar, or sleeve, mounted on each tube and of a plate where the sleeves are connected to. Accordingly, the portion of the tube-sheet and of the inlet tubes of the first tube-pass are not in direct contact with the inlet shell-side hot medium.

Document U.S. Pat. No. 3,437,077 describes a once-through vapour generator of shell-and-tube type, with U-shaped tubes concentrically arranged, wherein the hot and the cooling media flow on tube-side and shell-side respectively. The shell is provided with internal guiding jackets and baffles which form two passageways on shell-side in order to vaporize and superheat in sequence the cooling medium.

Document EP 0130404 discloses a U-tube heat exchanger where a multi-stage heat transfer occurs. The shell-side is provided with internal walls splitting the shell-side into at least two chambers sealingly separated. Each chamber is provided with its own inlet and outlet connections for inletting and outletting gaseous or liquid media in different physical states.

As shown by the above documents, a large set of possible shell-and-tube heat exchanger configurations can be adopted for cooling a hot medium, in particular a hot process gas. The selection of the heat exchanger configuration, which includes, among others, the selection of the hot medium side and the tube bundle type, depends on several parameters and constraints. Broadly, the designer is usually interested in increasing the heat transfer performance, in extending the design life and in reducing the capital cost of the exchanger.

In case the hot medium is installed on the shell-side, one major issue in designing a shell-and-tube heat exchanger is to avoid overheating and corrosion of shell walls. The above patent documents show that two major solutions can be adopted: the first solution consists in lining the internal shell walls by heat resistant materials (e.g. U.S. Pat. No. 4,561,496), whereas the second solution consists in sweeping the shell by the hot medium that had been previously cooled (e.g. U.S. Pat. Nos. 5,915,465, 4,907,643, WO 2017/001147 and U.S. Pat. No. 3,749,160).

As for the selection of the exchanging tubes, U-shaped tubes or bayonet-tubes are often preferred, since thermal-mechanical constraints due to tubes elongation are easily absorbed. However, U-shaped tubes and bayonet-tubes are affected by two potential drawbacks:

- they involve a multi-passes heat exchange configuration on tube-side and therefore, in case of temperature cross between hot and cold media, the heat transfer performance and operating stability may be endangered;
- they are sensitive in case the cooling medium flowing on tube-side is a vaporizing medium, since vaporization may occur in all tube passes.

In particular, beyond shell-and-tube heat exchanger configurations described in the above documents, two specific configurations realize to be problematic from design standpoint:

A) a hot medium flows on shell-side, a vaporizing cooling medium flows on tube-side specially under natural circulation, the tube bundle is one pass on shell-side and two passes on tube-side, the exchanging tubes are of U-shape type. With such configuration, vaporization in both legs of the U-shaped tubes may occur. This is dangerous, since the vaporization in both legs disturbs the natural or forced circulation and therefore can stop or delay the cooling medium flow with subsequent overheating or corrosion of tubes. This is more critical during start-ups, shut-downs and change of operating loads;

B) a hot medium flows on shell-side, a non-vaporizing cooling medium flows on tube-side, the tube bundle is one pass on shell-side and two passes on tube-side, the exchanging tubes are of U-shape type, a cross of hot and cooling media outlet temperatures occurs, hot and cold media are not contacted in a pure counter-current flow. With such configuration, the temperature cross is difficult to be prevented. As a consequence, the heat transfer performance and operating stability of the heat exchanger may significantly fall.

On the other hand, configurations A) and B) are potentially interesting for heat exchange applications where a medium at high temperature and pressure must be cooled as:

- the U-shaped tubes effectively absorb the thermal elongation during any steady-state or transient load;
- the pressure drop of a hot medium flowing on shell-side can be easily adjusted and reduced by adjusting the tube bundle geometry;
- a tube bundle with one pass on shell-side involves a simple geometry and low pressure drops;
- when the cooling medium flows on tube-side, the operating metal temperature of tubes can be usually kept closer to cooling medium temperature, since the tube-side heat transfer coefficient is usually well higher than the heat transfer coefficient of the shell-side;
- vaporization of a medium is usually more efficient and stable on tube-side rather than on shell-side due to larger convective flow component and simpler flow path;
- it is competitive to install a temperature cross in a single heat exchanger if thermal performance and operating stability are not endangered by the cross;
- the hot medium pressure is often lower than the cooling medium one;
- the hot medium flowing on shell-side can be confined and conveyed by an internal guiding jacket so that the shell and the tube-sheet are swept by the hot medium after cooling, as described in some documents above.

SUMMARY OF THE INVENTION

One object of the present invention is therefore to provide a shell-and-tube heat exchanger for process medium, such as process gas, typically hot process medium, which is capable of resolving the above mentioned drawbacks of the prior art in a simple, inexpensive and particularly functional manner.

In detail, one object of the present invention is to provide a shell-and-tube heat exchanger for process medium wherein the vaporization, in case of cooling medium at saturation conditions, or a temperature cross, in case of non-vaporizing cooling medium, is prevented or at least minimized in at least a portion of the tubes of the tube bundle.

Another object of the present invention is to provide a shell-and-tube heat exchanger for process medium which is capable of working always under stable and positive conditions from a thermal-hydraulic standpoint.

These and other objects are achieved according to the present invention by providing a shell-and-tube heat exchanger as well as a method of operating a shell-and-tube heat exchanger as set forth in the attached claims.

Specifically, these objects are achieved by a shell-and-tube heat exchanger having a cylindrical geometry and comprising a first pressure chamber and a second pressure chamber connected to a common tube-sheet on opposite sides. The first pressure chamber is provided with at least an inlet nozzle for inletting a first fluid and with at least an outlet nozzle for outletting the first fluid. The second pressure chamber is provided with at least a first nozzle for inletting or outletting a second fluid and with at least a second nozzle for outletting or inletting, respectively, the second fluid. The tube-sheet is connected to a tube bundle housed in the first pressure chamber and comprising a plurality of U-shaped exchanging tubes through which the second fluid flows to indirectly perform heat exchange with the first fluid. Each U-shaped exchanging tube is provided with a first portion and with a second portion. The first portion and the second portion of each U-shaped exchanging tube are hydraulically connected by a U-bend. The first pressure chamber contains at least one inner guiding jacket having a cylindrical or pseudo-cylindrical geometry and extending along the major longitudinal axis of said first pressure chamber. Said inner guiding jacket surrounds said first portion of each U-shaped exchanging tube for at least part of the respective length of said first portion. Said inner guiding jacket being sealingly connected, at a first end thereof, to the tube-sheet by first connection means and said inner guiding jacket being open at a second end thereof, thereby creating an at least partly stagnant zone within the inner guiding jacket preventing the first fluid flow across said first portion of each U-shaped exchanging tube, therefore preventing or reducing the heat transfer from the first fluid to the second fluid in said first portion of each U-shaped exchanging tube. These objects are also achieved by a method of operating a shell-and-tube heat exchanger having a cylindrical geometry and comprising a first pressure chamber and a second pressure chamber connected to a common tube-sheet on opposite sides, wherein the first pressure chamber is provided with at least an inlet nozzle and with at least an outlet nozzle, wherein the second pressure chamber is provided with at least a first nozzle and with at least a second nozzle, wherein the tube-sheet is connected to a tube bundle housed in the first pressure chamber and comprising a plurality of U-shaped exchanging tubes, wherein each U-shaped exchanging tube is provided with a first portion and with a second portion, wherein the first portion and the second portion of each U-shaped exchanging tube are hydraulically connected by a U-bend, the shell-and-tube heat exchanger being characterized in that the first pressure chamber contains at least one inner guiding jacket having a cylindrical or pseudo-cylindrical geometry and extending along the major longitudinal axis of said first pressure chamber, said inner guiding jacket surrounding said first portion of each U-shaped exchanging tube for at least part of the respective length of said first portion, said inner guiding jacket being sealingly connected, at a first end thereof, to the tube-sheet by first connection means, said inner guiding jacket being open at a second end thereof. The method comprises:

inletting a first fluid through the inlet nozzle of the first pressure chamber, inletting a second fluid through the first nozzle or the second nozzle of the second pressure chamber, flowing the second fluid through said plurality of U-shaped exchanging tubes to indirectly perform heat exchange with the first fluid, outletting the first fluid through the outlet nozzle of the first pressure chamber, outletting the second fluid through the second nozzle or the first nozzle, respectively, of the second pressure chamber, whereby the inner guiding jacket creates an at least partly stagnant zone within the inner guiding jacket preventing the first fluid flow across said first portion of each U-shaped exchanging tube, therefore preventing or reducing the heat transfer from the first fluid to the second fluid in said first portion of each U-shaped exchanging tube.

Further characteristics of the invention are underlined by the dependent claims, which are an integral part of the present description.

In detail, a preferred embodiment of the shell-and-tube heat exchanger for process medium according to the present invention is characterized by the following technical features:

it provides for an indirect heat exchange between a hot medium and a cooling medium;

it is of shell-and-tube type;

the tube bundle is one pass on shell-side and two passes on tube-side;

the tubes have a U-shaped configuration, with the legs that can be straight or of any other shape (like helix);

the hot medium flows on shell-side, whereas the cooling medium flows on tube-side;

the cooling medium is a vaporizing medium flowing under natural or forced circulation, or a non-vaporizing medium having an outlet temperature that is above the hot medium outlet temperature (temperature cross);

the hot and cooling media are not contacted in a pure counter-current configuration;

on the shell-side there are preferably two guiding jackets that convey the hot medium along the shell;

the first shell-side guiding jacket, in communication with the hot medium inlet nozzle, surrounds most length of the tube bundle and most length of the second shell-side guiding jacket;

the first shell-side guiding jacket forms a gap with the shell, said gap being in communication with the tube bundle and the hot medium outlet nozzle;

the second shell-side guiding jacket, sealingly connected to the tube-sheet and having an open end, totally or partially surrounds one set of the U-tubes legs and prevents, or reduces, the heat exchange between the two media for the portion of surrounded legs;

ideally, the tube layout is of concentric type, with one set of legs installed in a circular central region of the tube-sheet and the other set of legs installed in a circular outer region surrounding the central region;

the tube bundle is preferably in vertical position, with downward U-tubes.

The shell-and-tube heat exchanger for process medium according to the present invention is conceived to safely and efficiently work when the above configurations A) and B) are adopted. Actually, in configuration A), when a vaporizing medium is used as cooling medium, specially flowing under natural circulation, the inlet U-tubes legs (first tube-pass) do not participate, or minorly participate, to the heat exchange and therefore there is negligible vaporization in the inlet legs. As a consequence, the natural or forced circulation is always positively and steadily installed in the heat exchanger. Moreover, preferably the tube-sheet and the shell get in contact with the inlet hot medium after at least a portion of the heat exchange has occurred, i.e. after the hot medium has been at least partially cooled.

In configuration B), when a non-vaporizing medium is used as cooling medium, when the hot and cooling media are not contacted in a pure counter-current flows configuration, and when the cooling medium outlet temperature is higher than the outlet temperature of the hot medium, that is when a temperature cross occurs within the exchanger, the portion of U-tubes legs where the temperature cross could arise do not participate, or marginally participate, to heat exchange and therefore the temperature cross on the tube bundle is prevented. As a consequence, the heat transfer is always kept stable and with a positive performance. Moreover, the tube-sheet and the shell get in contact with the inlet hot medium after at least a portion of the heat exchange has occurred, i.e. after the hot medium has been at least partially cooled.

BRIEF DESCRIPTION OF THE DRAWINGS

The characteristics and advantages of a shell-and-tube heat exchanger for process gas according to the present invention will be clearer from the following exemplifying and non-limiting description, with reference to the enclosed schematic drawings, in which.

DETAILED DESCRIPTION OF THE PREFERRED EMBODIMENTS

Figure 1:
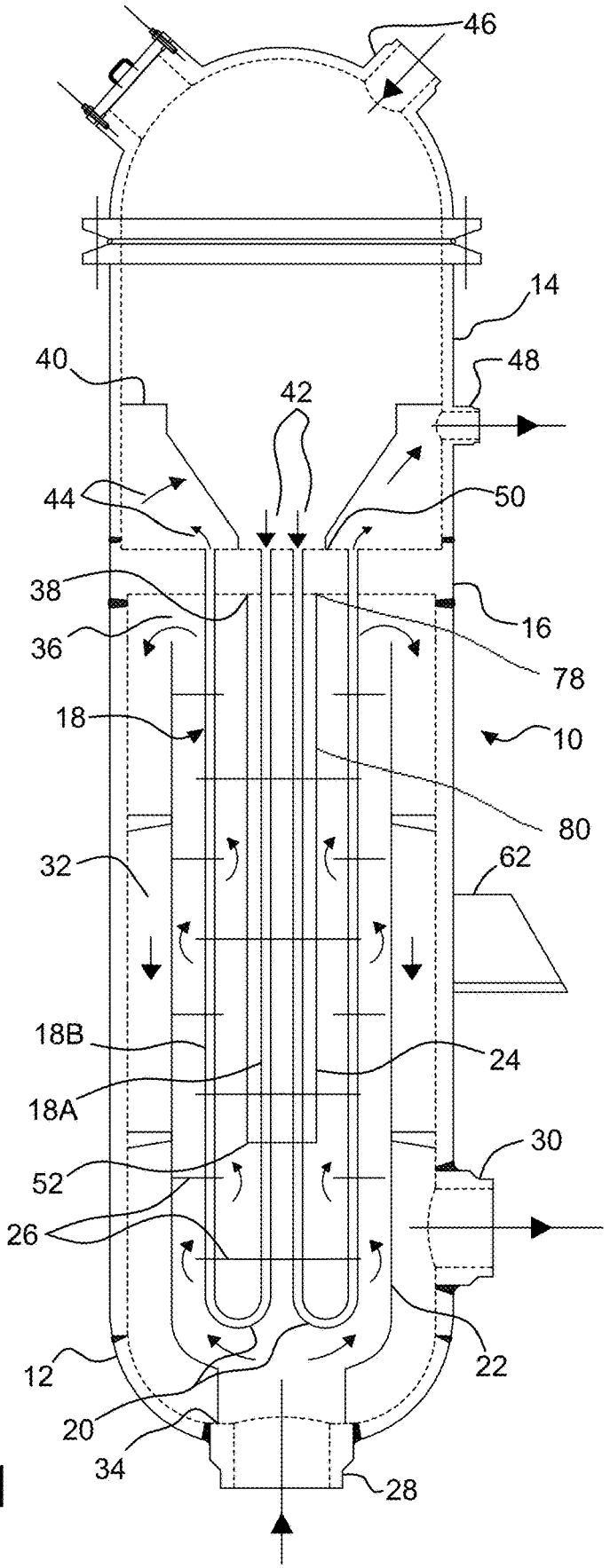
FIGS. 1 and 2 schematically show, in two respective operating conditions, a first embodiment of the shell-and-tube heat exchanger according to the present invention.

With reference to figures, some embodiments of the shell-and-tube heat exchanger 10 according to the present invention are shown. The heat exchanger 10 has a cylindrical geometry and comprises a first pressure chamber 12 and a second pressure chamber 14 connected to a common tube-sheet 16 on opposite sides. The tube-sheet 16 is connected to a tube bundle comprising a plurality of U-shaped exchanging tubes 18 housed in the first pressure chamber 12.

Each U-shaped tube 18 is provided with a first portion or leg 18A and with a second portion or leg 18B. The first leg 18A and the second leg 18B of each U-shaped tube 18 are hydraulically connected by a U-bend 20. The first leg 18A and the second leg 18B of each U-shaped tube 18 can be either straight or of other shape (like helix). Both ends of each U-shaped tube 18 are connected to the tube-sheet 16.

A first fluid, i.e. a hot medium, flows in the first pressure chamber 12, also called "shell", and a second fluid, i.e. the cooling medium, flows in the second pressure chamber 14, which is also called "channel". The second pressure chamber 14 is in communication with the U-shaped tube 18. In other words, the hot medium flows on shell-side, and the cooling medium flows on tube-side. The shell-and-tube heat exchanger 10 is configured to guide the first fluid across a portion of the tube bundle before contacting the tube-sheet 16. The shell-and-tube heat exchanger 10 is configured to guide the first fluid across at least a portion of the second legs 18B of the tube bundle before contacting the tube-sheet 16. Thus, the shell-and-tube heat exchanger 10 is configured to guide the first fluid such that a portion of heat is exchanged between the first fluid and the second fluid before the first fluid contacts the tube-sheet 16. The first fluid is admitted into the first pressure chamber 12 in a point so that the first fluid flows towards the tube-sheet 16 by exchanging at least a portion of heat with the second fluid.

The first pressure chamber 12 is provided with one or more hot medium inlet nozzles 28 and with one or more hot medium outlet nozzles 30. Inlet 28 and outlet 30 nozzles are located far from the tube-sheet 16, preferably near or after the U-bends 20. That the first fluid is a hot medium or warmer medium means that the first fluid is warmer than the second fluid when fed to the heat exchanger, i.e. the first fluid is warmer when fed to the heat exchanger than the second fluid when fed to the heat exchanger. In other words, the first fluid is warmer when entering the heat exchanger through the inlet nozzle 28 than the second fluid is when entering the heat exchanger through the first nozzle 46 or the second nozzle 48. The second fluid is a cooling medium and can also be denoted cold medium. That the second fluid is a cold medium or colder medium means that the second fluid is colder than the first fluid when fed to the heat exchanger. The second fluid is colder when fed to the heat exchanger than the first fluid when fed to the heat exchanger. In other words, the second fluid is colder when entering the heat exchanger through the first nozzle 46 or the second nozzle 48 than the first fluid is when entering the heat exchanger through the inlet nozzle 28.

The inlet nozzle 28 of the first pressure chamber 12 is arranged at a distance from the tube-sheet 16 such that the first fluid is guided across a portion of the tube bundle before contacting the tube-sheet 16. The inlet nozzle 28 of the first pressure chamber 12 is arranged at a distance from the tube-sheet 16 such that the first fluid is guided across at least a portion of the second legs 18B of the tube bundle before contacting the tube-sheet 16. Thereby, the first fluid flows from the inlet nozzle of the first pressure chamber 12 towards the tube-sheet 16 exchanging at least a portion of heat with the second fluid.

The first pressure chamber 12 contains at least one outer guiding jacket 22 and at least one inner guiding jacket 24. Each outer 22 and inner 24 guiding jacket has a cylindrical or pseudo-cylindrical geometry and extends along the major longitudinal axis of the first pressure chamber 12. The outer guiding jacket 22 extends until to or after the U-bends 20. The first pressure chamber 12 also contains a plurality of baffles or grids 26 that, together with the exchanging tubes 18, forms the tube bundle.

The outer guiding jacket 22 and the first pressure chamber 12 form a gap 32 in between. The gap 32 is in communication with the hot medium outlet nozzle 30. The outer guiding jacket 22 surrounds both a length portion, preferably most length, i.e. a major length portion, of the tube bundle and a length portion, preferably most length, i.e. a major length portion, of the inner guiding jacket 24. The length portion of the tube bundle surrounded by the outer guiding jacket 22 preferably comprises the U-bends 20. The outer guiding jacket 22 preferably surrounds a length portion of the tube bundle including the U-bends 20. The outer guiding jacket 22, at a first end thereof which is facing away and far from the tube-sheet 16, is in communication with the hot medium inlet nozzle 28 by means of a connection conduit 34 and receives the hot medium from the inlet nozzle 28 at an opposite side of the U-bends 20 to the side where the tube bundle is connected to the tube sheet 16 or near the U-bends 20. In this context, the introduction of the hot medium to the outer guiding jacket 22 at an opposite side of the U-bends 20 to the side where the tube bundle is connected to the tube-sheet 16 implies that the entry of the hot medium into the tube bundle does not occur in between the U-bends 20 and the tube-sheet 16. The outer guiding jacket 22, at a second end thereof which is facing and near to the tube-sheet 16, has an opening 36 that is in communication with the gap 32. The outer guiding jacket 22 may be configured to guide the first fluid across a portion of the tube bundle before contacting the tube-sheet 16. The connection conduit 34, which connects the inlet nozzle 28 with the outer guiding jacket 22, may be configured to guide the first fluid across a portion of the tube bundle before contacting the tube-sheet 16.

The joining portion between the inlet nozzle 28 and the connection conduit 34 of the outer guiding jacket 22 is preferably sealed. On the contrary, if no sealing is provided, the outer guiding jacket 22 can be provided, near the connection conduit 34, with a regulating device (not shown) for intentionally bypassing a specific amount of the hot medium from the inlet nozzle 28 to the gap 32. Such a bypass is useful to control the hot medium temperature at the outlet nozzle 30.

The inner guiding jacket 24 totally surrounds the set of first U-tubes legs 18A on azimuthal (circular) direction and surrounds on longitudinal direction said set of first U-tubes legs 18A for at least part of their respective length. More specifically:

- in case the cooling medium is a vaporizing fluid flowing under natural circulation, the inner guiding jacket 24 totally, or almost totally, surrounds the set of first legs 18A, i.e. the legs 18A of the tubes 18 where the cooling medium enters (first tube-pass), in longitudinal direction;
- in case the cooling medium is a vaporizing fluid flowing under forced circulation, the inner guiding jacket 24 totally or partially surrounds the set of first legs 18A, i.e. the legs 18A of the tubes 18 where the cooling medium enters (first tube-pass), in longitudinal direction;
- in case the cooling medium is a non-vaporizing fluid, the inner guiding jacket 24 partially surrounds the set of first legs 18A, i.e. the legs 18A of the tubes 18 where the cooling medium exits (second tube-pass), in longitudinal direction.

The inner guiding jacket 24, at a first end 78 thereof which is facing and near to the tube-sheet 16, is sealingly connected to said tube-sheet 16 by first connection means 38. The inner guiding jacket 24, at a second end 52 thereof which is facing away and far from the tube-sheet 16, is open, in which case there will be an at least partially stagnant zone within the inner guiding jacket 24, which reduces heat exchange between the second fluid in the first legs 18A and the first fluid. Thus, the inner guiding jacket 24 is open at a second end 52 thereof, thereby creating an at least partly stagnant zone within the inner guiding jacket 24 preventing the first fluid flow across said first portion 18A of each U-shaped exchanging tube 18, therefore preventing, or reducing, the heat transfer from the first fluid to the second fluid in said first portion 18A of each U-shaped exchanging tube 18. The inner guiding jacket 24 prevents the flow of the first fluid, e.g. hot medium, across the surrounded portion of the enclosed U-tubes legs 18A and therefore prevents, or reduces, the heat transfer from the first fluid, e.g. hot medium, to the second fluid, e.g. cooling medium, in said portion of the U-tubes legs 18A. The inner guiding jacket 24, in other words, has the purpose to prevent, or reduce, for the surrounded portion of the U-tubes legs 18A, either the vaporization, in case the cooling medium is at saturation conditions, or a temperature cross, in case of non-vaporizing cooling medium. The second end 52 may be provided with a plate having through holes or windows for the passage of the first U-tubes legs 18A. The plate may be a perforated plate. Alternatively, the plate may be a rigid plate except for the through holes or windows for the passage of the first U-tubes legs 18A and possibly further equipment or devices, wherein at least one of the through holes or windows are larger than the cross-section of the first U-tube legs 18A and possibly further equipment or devices.

The inner guiding jacket 24 comprises an envelope surface 80. The envelope surface 80 extends from the first end (78) to the second end (52) of the inner guiding jacket (24). The envelope surface 80 is non-perforated. Thus, the envelope surface 80 does not have any perforations or through holes. The envelope surface is non-permeable. The first fluid cannot penetrate the envelope surface 80. The envelope surface 80 forms a hollow cylinder or pseudo-cylinder. The envelope surface is not provided with any (inlet or outlet) opening for circulating a fluid inside the inner guiding jacket. The inner guiding jacket is neither provided with inlet and outlet openings for circulating a fluid inside the inner guiding jacket. The inner guiding jacket is only provided with opening(s) at the open second end. No opening is provided elsewhere on the inner guiding jacket, whereby no circulation of fluid inside the inner guiding jacket is obtained and thus the fluid inside the inner guiding jacket is predominantly stagnant. The inner guiding jacket 24 is not sealingly separated from the rest of the first pressure chamber 12. The first fluid can fill in the inner guiding jacket 24, but the first fluid cannot continuously flow through, i.e. in and out of, the inner guiding jacket 24. Instead, the first fluid inside the inner guiding jacket is predominantly stagnant.

The second pressure chamber 14 contains a second pressure chamber guiding jacket 40 that separates the second pressure chamber 14 into a first section 42 and a second section 44. The first section 42 and the second section 44 are non-directly communicating with each other. The first section 42 and the second section 44 are communicating with each other through the U-shaped exchanging tubes 18. The second pressure chamber 14 is also provided with at least a first nozzle 46 for inletting or outletting the cooling medium and with at least a second nozzle 48 for outletting or inletting the cooling medium. The second pressure chamber guiding jacket 40 is connected to the tube-sheet 16 or to one set of U-tubes legs 18A and 18B by second connection means 50. As a result, each section 42 and 44 of the second pressure chamber 14 is in communication with one set of U-tubes legs 18A or 18B. The first portion 18A of the U-shaped exchanging tubes 18 is in communication with the first section 42 and the second portion 18B of the U-shaped exchanging tubes 18 is in communication with the second section 44.

The first section 42 and the second section 44 of the second pressure chamber 14 can be also in communication by means of a regulating valve installed in the second pressure chamber 14. Such a regulating valve can act as a bypass device for bypassing a portion of the second fluid and therefore be useful for controlling the outlet temperature of the second fluid.

Figure 5:
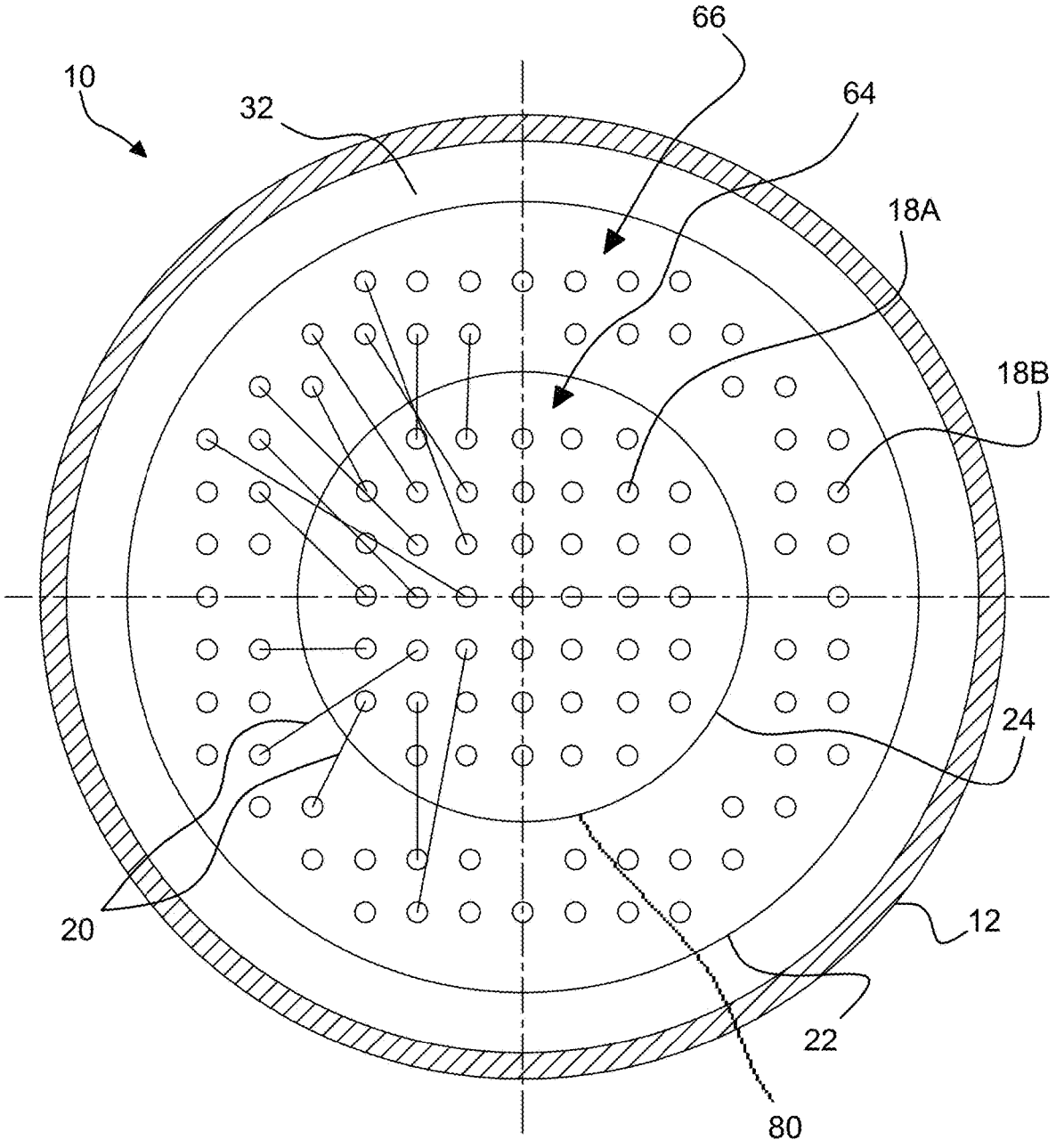
FIG. 5 is a cross-sectional view obtained in a middle portion of the shell-and-tube heat exchanger of any FIGS. 1 to 4.

Preferably, the tube 18 layout is of concentric type as shown in FIG. 5, with the first legs 18A arranged in a circular central portion of the tube-sheet 16 ("centre" 64, see FIG. 5) and with the second legs 18B arranged in a circular portion surrounding the central portion of said tube-sheet 16 ("crown" 66, see FIG. 5). As per such preferred tube layout, the following heat exchanger 10 configuration can be preferably adopted:

- the inner guiding jacket 24 is concentrically installed inside the first pressure chamber 12 and surrounds the first legs 18A connected to the "centre" of the tube-sheet 16 regardless the cooling medium. Consequently, the first legs 18A represents the first tube-pass in case of vaporizing cooling medium and the second tube-pass in case of a non-vaporizing cooling medium;
- the outer guiding jacket 22 is concentrically installed inside the first pressure chamber 12 and surrounds most length of the tube bundle and most length of the inner guiding jacket 24;
- the two sections 42 and 44 of the second pressure chamber 14 are concentrically arranged in said second pressure chamber 14, wherein a first inner section 42 is in fluid communication with the first legs 18A and a second outer section 44 is in fluid communication with the second legs 18B;
- in case of vaporizing cooling medium (see FIGS. 1 and 3), the cooling medium enters into the inner section 42 from a first nozzle 46 of the second pressure chamber 14, then said cooling medium enters into the first legs 18A (first tube-pass), flows along the tubes 18, exits from the second legs 18B (second tube-pass), enters into the outer section 44 and then exits from the second nozzle 48 of the second pressure chamber 14;
- in case of a non-vaporizing cooling medium (see FIGS. 2 and 4), the cooling medium enters into the outer section 44 from the second nozzle 48 of the second pressure chamber 14, then said cooling medium enters into the second legs 18B (first tube-pass), flows along the tubes 18, exits from the first legs 18A (second tube-pass), enters into the inner section 42 and then exits from the first nozzle 46 of the second pressure chamber 14.

In case the cooling medium is a vaporising medium flowing under natural circulation, the heat exchanger 10 is preferably disposed in a vertical position (referring to the major longitudinal axis of its shell), with the tube bundle oriented downward. Otherwise, the heat exchanger 10 can be either vertical or horizontal regardless the orientation of the tube bundle.

On shell-side (i.e. the hot medium side), the heat exchanger 10 shown in FIGS. 1 and 2 works in the following way. The hot medium enters into the outer guiding jacket 22 from the inlet nozzle 28, then flows along the outer guiding jacket 22 towards the tube-sheet 16 by crossing the U-tubes 18, except for the portion of said U-tubes 18 surrounded by the inner guiding jacket 24, according to the flow path defined by the baffles or grids 26. Along the tube bundle, the hot medium indirectly releases heat to the cooling medium which flows in the U-tubes 18, except for the portion of said U-tubes 18 surrounded by the inner guiding jacket 24. The two media are therefore contacted according to:

- a pure, or almost pure, co-current configuration in case of vaporizing cooling medium in natural circulation (FIG. 1), preferably, the inner guiding jacket 24 totally, or almost totally, surrounds the first portion 18A of the U-shaped exchanging tubes 18 in longitudinal direction;
- a pure, or almost pure, co-current configuration or both co-current and counter-current configurations in case of vaporizing cooling medium in forced circulation (FIG. 1), preferably, the inner guiding jacket 24 totally or partially surrounds the first portion 18A of the U-shaped exchanging tubes 18 in longitudinal direction;
- both co-current and counter-current configurations in case of a non-vaporizing cooling medium which outlet temperature is higher than hot medium outlet temperature (FIG. 2), preferably, the inner guiding jacket 24 partially surrounds the first portion 18A of the U-shaped exchanging tubes 18 in longitudinal direction.

Near the tube-sheet 16, the hot medium exits from the outer guiding jacket 22 by the opening 36, makes a U-turn, enters into the gap 32 and then flows towards the outlet nozzle 30, from which said hot medium exits from the heat exchanger 10. The hot medium exiting from the opening 36 has been cooled. Therefore, the portions of the tube-sheet 16 and the first pressure chamber 12, that are in contact with the hot medium, are swept by the cooled hot medium. In case an amount of inlet hot medium is bypassed before crossing the tube bundle, for instance by means of a regulating valve installed on the conduit 34, this amount of inlet hot medium is mixed with the cooled hot medium flowing in the gap 32 before leaving from the outlet nozzle 30.

On tube-side (i.e. the cooling medium side), the heat exchanger 10 works in the following way. In a first operating condition (FIG. 1) the cooling medium is a vaporizing medium flowing under natural circulation. The heat exchanger 10, sometimes called process evaporator, vapour generator, process gas boiler or waste heat boiler depending on the hot and cooling media, is preferably in a vertical position, with the tube bundle directed downward. In case of the preferred concentric layout of the U-tubes 18, as shown in FIG. 5, the vaporizing cooling medium at saturation conditions, or nearly at saturation conditions, is in liquid phase and enters into the inner section 42 of the second pressure chamber 14 from the first nozzle 46. The U-tubes first legs 18A of the tube-sheet 16 central portion 64 are in communication with the inner section 42, whereas the U-tubes second legs 18B of the tube-sheet 16 "crown" or peripheral portion 66 are in communication with the outer section 44 of the second pressure chamber 14.

The vaporizing cooling medium in the inner section 42 enters into the U-tubes first legs 18A (first tube-pass) and flows down under natural circulation. The inner guiding jacket 24 totally, or almost totally, surrounds the U-tubes first legs 18A to prevent, or reduces, the heat transfer from hot medium to cooling medium and therefore to prevent the vaporization in the U-tubes first legs 18A. At the second end 52 of the inner guiding jacket 24, the vaporizing cooling medium leaves the surrounded portion of the U-tubes first legs 18A and starts to exchange heat with the hot medium. Soon, the vaporizing cooling medium makes a U-turn in the U-bends 20, then naturally moves upward in the second legs 18B (second tube-pass) where cooling of the hot medium occurs by vaporization.

As well known, a liquid fluid and its liquid-and-vapour mixture at same temperature, or at close temperatures, have different densities. Such a difference is the driving force for the natural circulation. The two-phase mixture exiting from the second legs 18B is discharged into the outer section 44 of the second pressure chamber 14 and then leaves the heat exchanger 10 from the second nozzle 48. First 46 and second 48 nozzles of the second pressure chamber 14 can be connected to a separated and elevated equipment (not shown), commonly called liquid-and-vapour drum, which provides for required static head for natural circulation and for liquid-and-vapour separation.

Since the U-tubes first legs 18A are adiabatic, or almost adiabatic, no significant vaporization occurs in the first tube-pass and therefore the natural circulation is not disturbed. The heat exchanger 10 works always under stable and positive conditions from thermal-hydraulic standpoint. In a second operating condition (FIG. 1) the cooling medium is a vaporizing medium flowing under forced circulation. Once again the heat exchanger 10 is preferably in vertical position, with the tube bundle directed downward. In case of the preferred concentric layout of the U-tubes 18, as shown in FIG. 5, the vaporizing cooling medium at saturation conditions, or nearly at saturation conditions, enters into the inner section 42 from the first nozzle 46 in liquid phase. The U-tubes first legs 18A of the tube-sheet 16 central portion 64 are in communication with the inner section 42, whereas the U-tubes second legs 18B of the tube-sheet 16 "crown" or peripheral portion 66 are in communication with the outer section 44 of the second pressure chamber 14.

The vaporising cooling medium in the inner section 42 enters into the U-tubes first legs 18A (first tube-pass) and flows down under forced circulation. The inner guiding jacket 24 totally or partially surrounds the U-tubes first legs 18A to prevent, or reduce, the heat transfer from hot medium to cooling medium and therefore to prevent the vaporization in the surrounded portion of the U-tubes first legs 18A. At the second end 52 of the inner guiding jacket 24, the vaporizing cooling medium leaves the surrounded portion of the U-tubes first legs 18A and starts to exchange heat with the hot medium. When the vaporising cooling medium arrives at the U-bends 20, it has a U-turn and moves upward in the U-tubes second legs 18B (second tube-pass). The liquid-and-vapour mixture exiting from the U-tubes second legs 18B is discharged into the outer section 44 of the second pressure chamber 14 and then leaves the heat exchanger 10 from the second nozzle 48. Also in this second operating condition the first 46 and second 48 nozzles of the second pressure chamber 14 can be connected to a separated equipment, commonly called liquid-and-vapour drum, which provides for liquid-and-vapour separation.

Since the portion of the U-tubes first legs 18A surrounded by the inner guiding jacket 24 is adiabatic, or partially adiabatic, the vaporization in such portion of the first tube-pass is eliminated or reduced. This has a positive effect on forced circulation since the liquid in the first tube-pass contributes to natural draft. Such a contribution is more important, or even essential, in case of failure of the pumping device or during transients.

In a third operating condition (FIG. 2) the cooling medium is a non-vaporizing medium which, at the heat exchanger outlet (first nozzle 46), has a temperature higher than outlet hot medium temperature (i.e. a temperature cross occurs). The cooling medium can be sub-cooled water, steam or any other fluid in vapour or liquid phase. In this operating condition the heat exchanger 10 can be commonly called water pre-heater, steam super-heater or cooler, respectively. In case of the preferred concentric layout of the U-tubes 18, as shown in FIG. 5, the cooling medium enters into the outer section 44 from the second nozzle 48, and then enters into the U-tubes second legs 18B (first tube-pass). The cooling medium flows along the U-tubes second legs 18B, has a U-turn in the U-bends 20 and then flows in the U-tubes first legs 18A (second tube-pass). The cooling medium indirectly exchanges heat with the hot medium along the U-tubes second legs 18B and along the U-tubes first legs 18A not surrounded by the inner guiding jacket 24. Subsequently, in the tube 18 portion between the second end 52 of the inner guiding jacket 24 and the tube-sheet 16, the U-tubes first legs 18A do not contribute or minorly contribute to the heat exchange between the two media. The temperature of the cooling medium at the second end 52 of the inner guiding jacket 24 is equal to or lower than the hot medium temperature at this point of the tube-bundle. Therefore, the temperature cross is prevented. As a result, even if the temperature of the cooling medium is higher than the temperature of the hot medium at the heat exchanger outlet and the heat exchanger has not a pure counter-current configuration, the temperature cross along the tube-bundle is prevented and therefore the heat exchanger works always under stable and positive performance from thermal standpoint.

Figure 3:
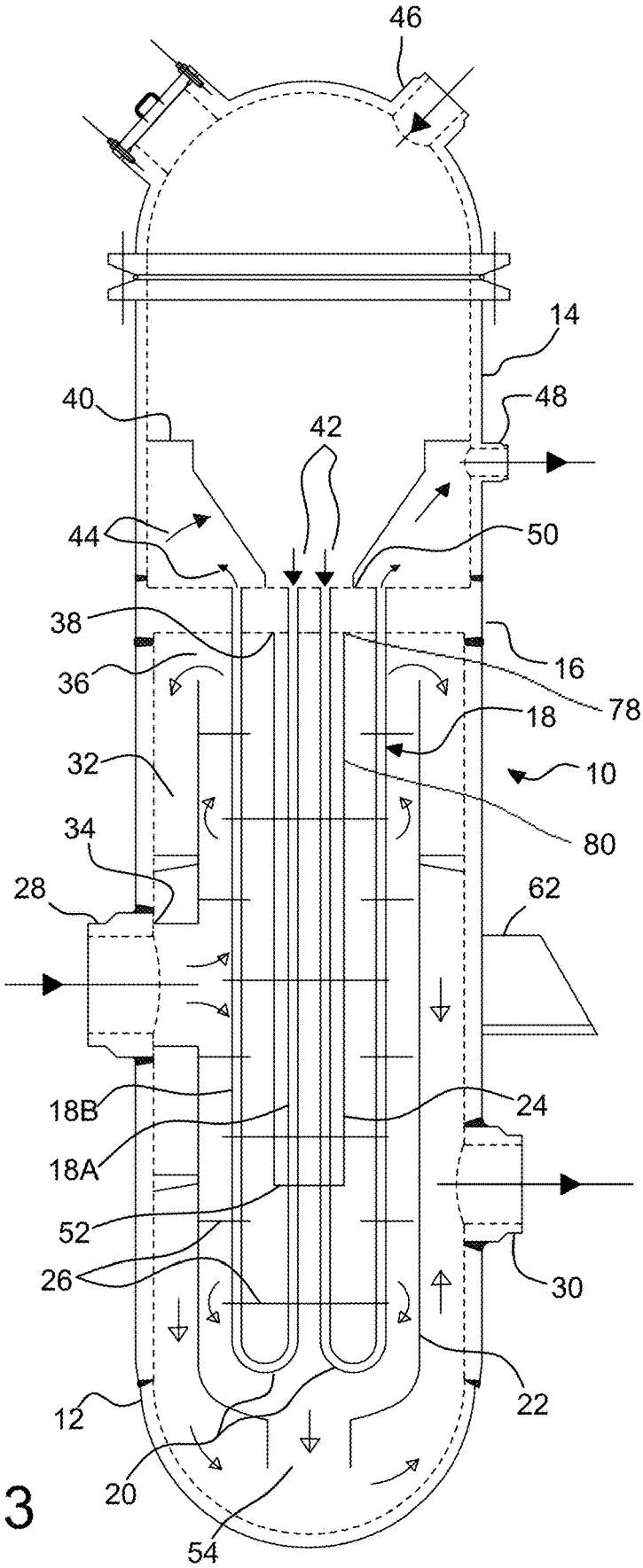
FIGS. 3 and 4 schematically show, in two respective operating conditions, a second embodiment of the shell-and-tube heat exchanger according to the present invention.
Figure 4:
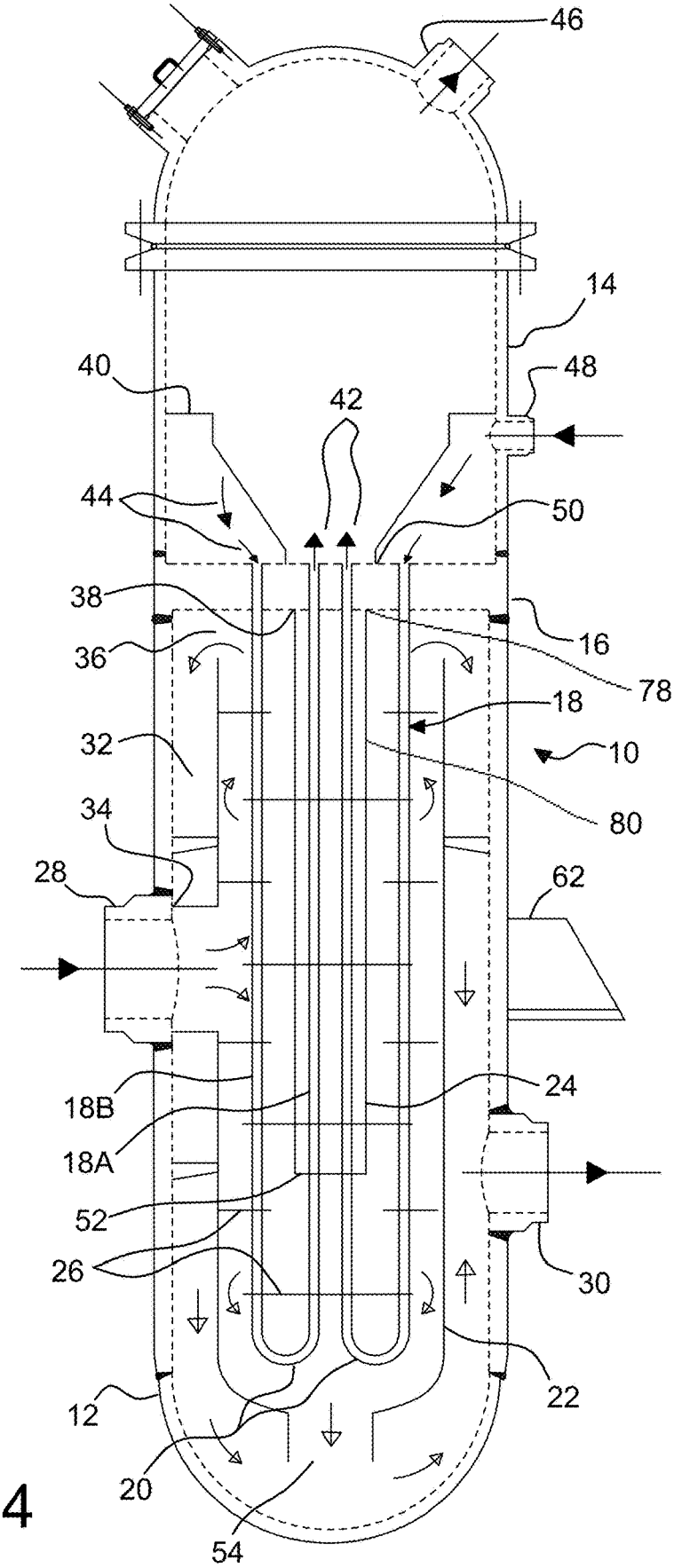

In FIGS. 3 and 4 a second embodiment of the shell-and-tube heat exchanger 10 for process gas according to the present invention is schematically shown. This second embodiment of the heat exchanger 10 is almost identical to the first one described above, except for:

- the outer guiding jacket 22 has the two ends both open;
- the inlet hot medium is admitted into the outer guiding jacket 22 in a point in between the tube-sheet 16 and the U-bends 20, e.g. in a point within a region midways between the tube-sheet 16 and the U-bends 20;
- the hot medium splits in two portions across the tube bundle.

Inlet 28 and outlet 30 nozzles of the first pressure chamber 12 are located on said first pressure chamber 12 preferably in between the tube-sheet 16 and the U-bends 20 e.g. in a region midways between the tube-sheet 16 and the U-bends 20. The first end of the outer guiding jacket 22, i.e. the end of the outer guiding jacket 22 which is facing away from and far from the tube-sheet 16, is thus provided with an opening 54 that is in communication with the gap 32.

On shell-side (i.e. the hot medium side), the heat exchanger 10 shown in FIG. 3 works in the following way. The inlet hot medium enters into the outer guiding jacket 22, from the inlet nozzle 28 and by means of the connection conduit 34, in a point that is located in between the tube-sheet 16 and the U-bends 20. Since the outer guiding jacket 22 is provided with two openings 36 and 54, the inlet hot medium splits into two portions, flowing respectively towards the first (upper) opening 36 and the second (lower) opening 54 of the outer guiding jacket 22. Both fluid portions cross the tube bundle, in opposite directions, and exchange heat with the cooling medium flowing on tube-side, except for the portion of tubes 18 surrounded by the inner guiding jacket 24. The two fluid portions exiting from the first (upper) opening 36 and the second (lower) opening 54 are cooled, then they make a U-turn and enter into the gap 32 and both portions move towards the outlet nozzle 30. The two media are therefore contacted according to:

- both co-current and counter-current configurations in case of vaporizing cooling medium flowing under natural or forced circulation;
- both co-current and counter-current configurations in case of a non-vaporizing cooling medium which outlet temperature is higher than hot medium outlet temperature.

The outer guiding jacket 22, near the connection conduit 34 with the inlet nozzle 28, can be sealed or not. If not sealed, the outer guiding jacket 22 can be provided, near the connection conduit 34, with a regulating device (not shown) for intentionally bypassing a specific amount of the hot medium from the inlet nozzle 28 to the gap 32. Such a bypass device is useful to control the hot medium temperature at the outlet nozzle 30.

Figure 2:
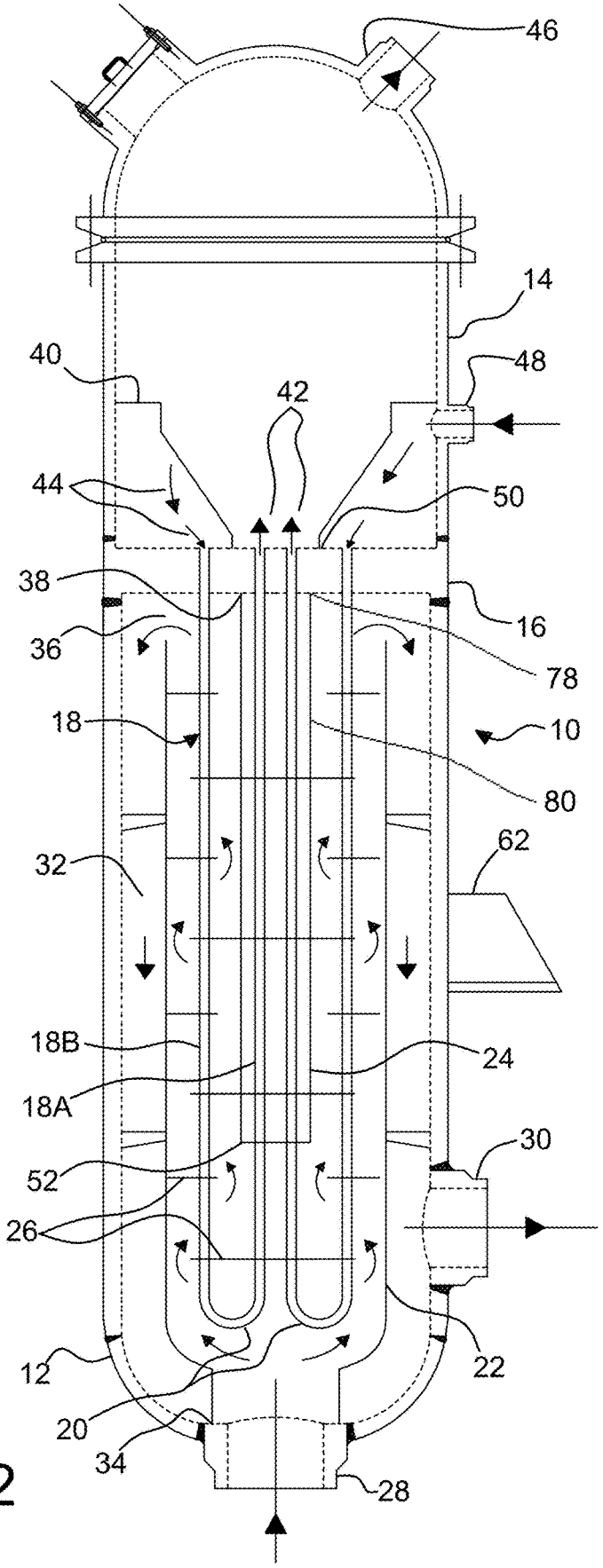

On tube-side (i.e. the cooling medium side), the heat exchanger 10 shown in FIGS. 3 and 4 works in the same way as the first embodiment of the heat exchanger 10 shown in FIGS. 1 and 2, respectively.

In one aspect, the shell-and-tube heat exchanger 10 has a one pass configuration on the tube bundle. In one aspect, the shell-and-tube heat exchanger 10 has a two passes configuration on the tube-side. The tube bundle may be one pass on shell-side. The first fluid may flow across the tube bundle by one pass. The tube bundle may be two passes on tube-side. The second fluid may flow through the tube bundle by two passes.

In one aspect, said first fluid and said second fluid are not contacted according to a pure counter-current flows configuration.

In one aspect, the cooling medium is a vaporizing medium introduced into the heat exchanger 10 at, or near at, saturation conditions and flowing under natural or forced circulation.

In one aspect, the cooling medium is a non-vaporizing medium and the temperature at the heat exchanger 10 outlet is above the temperature of the hot medium at the heat exchanger 10 outlet.

Figure 6:
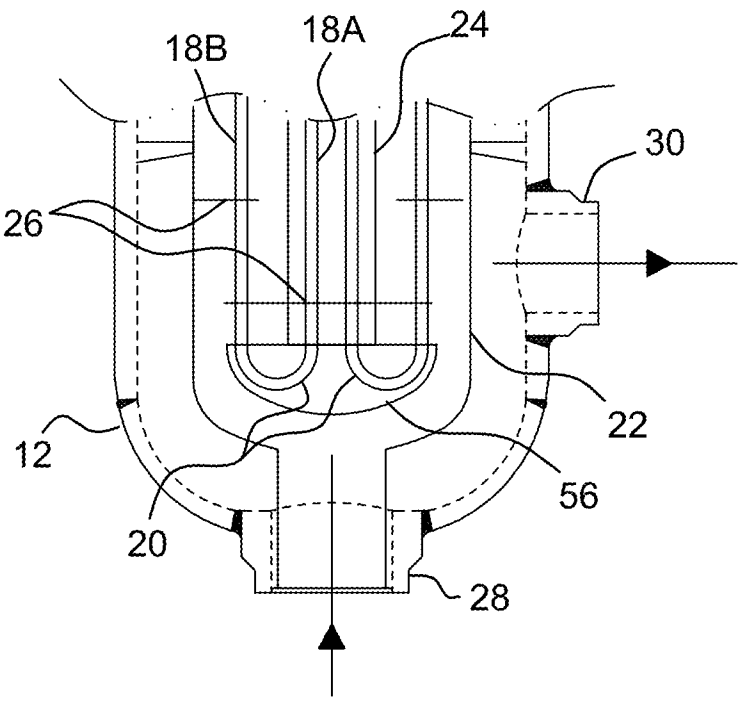
FIG. 6 schematically and partially shows a third embodiment of the shell-and-tube heat exchanger according to the present invention.

In FIG. 6 a third embodiment of the shell-and-tube heat exchanger 10 for process medium, such as process gas, according to the present invention is schematically and partially shown. In this embodiment the U-bends 20 of the U-shaped tubes 18, connected to the first legs 18A and the second legs 18B of said tubes 18, are surrounded by a terminal guiding jacket 56 housed in the first pressure chamber 12. The terminal guiding jacket 56 thus prevents, or reduces, the hot medium flow across the U-bends 20. Thereby, heat exchange over the U-bends is prevented. In particular, is continuous flow of hot medium across the U-bends prevented. The terminal guiding jacket 56 is preferably in the form of a partly spherical or partly pseudo-spherical shell, such as a semi-spherical shell. The terminal guiding jacket 56 can be provided with one or more additional insulating layers, also of "sandwich" type. The terminal guiding jacket 56 can be adopted both in case the vaporization of the cooling medium must be avoided in the U-bends 20, and in case there is risk of vibrations of said U-bends 20 due to the hot medium flow. The U-bends 20 of the U-shaped exchanging tubes 18 are surrounded by a terminal guiding jacket 56 housed in the first pressure chamber 12, said terminal guiding jacket 56 being configured to prevent flow of the first fluid across said U-bends 20.

The U-bends 20 of the U-shaped exchanging tubes 18 are surrounded by a terminal guiding jacket 56 housed in the first pressure chamber 12, whereby flow of the first fluid across said U-bends 20 is prevented. The terminal guiding jacket 56 shields the U-bends 20. The terminal guiding jacket 56 shields the U-bends 20 against the flow of the first fluid. The terminal guiding jacket 56 directs the flow of the first fluid away from the U-bends 20. The terminal guiding jacket 56 may have a closed side facing away from the U-shaped exchanging tubes, i.e. facing the flow of the first fluid. The terminal guiding jacket 56 may have an open side facing the U-shaped exchanging tubes 18. The terminal guiding jacket 56 is thus not sealingly closed. The terminal jacket 56 is not provided with any (inlet or outlet) openings for circulating any fluid therein.

Figure 7:
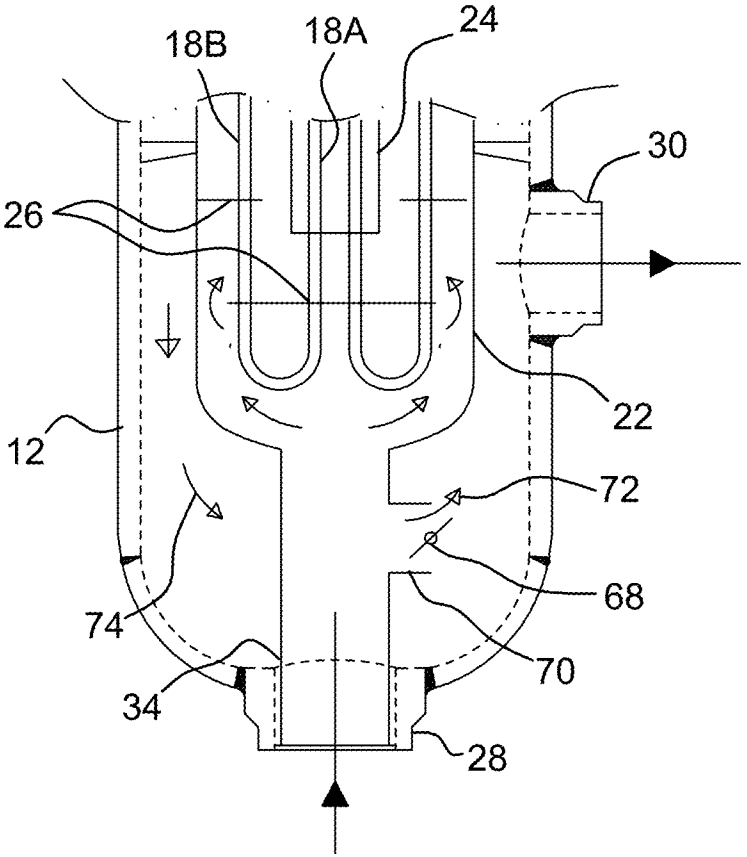
FIG. 7 schematically and partially shows a fourth embodiment of the shell-and-tube heat exchanger according to the present invention.

In FIG. 7 a fourth embodiment of the shell-and-tube heat exchanger 10 for process gas according to the present invention is schematically and partially shown. In this embodiment a bypass valve 68 is installed in a bypass conduit 70 obtained on the connection conduit 34 between the inlet nozzle 28 and the outer guiding jacket 22. The bypass valve 68 is configured for directly delivering to the gap 32 at least one part 72 of the fluid that enters from the inlet nozzle 28. In other words, said part 72 of the fluid does not enter the outer guiding jacket 22, whereas it is mixed, at the bypass valve 68, with another part 74 of fluid exiting from said outer guiding jacket 22 and flowing through the gap 32. This arrangement is in principle possible both for the arrangement shown in FIGS. 1 and 2 and the arrangement shown in FIGS. 3 and 4. The connection conduit 34 is provided with a bypass conduit 70, which forms an opening. The bypass valve 68 is installed in the bypass conduit 70. The bypass valve 68 is typically a regulating valve. In short, a bypass valve 68 may be installed in a bypass conduit 70 obtained on the connection conduit 34 between the inlet nozzle 28 and the outer guiding jacket 22.

Figures 8A, 8B, 8C:
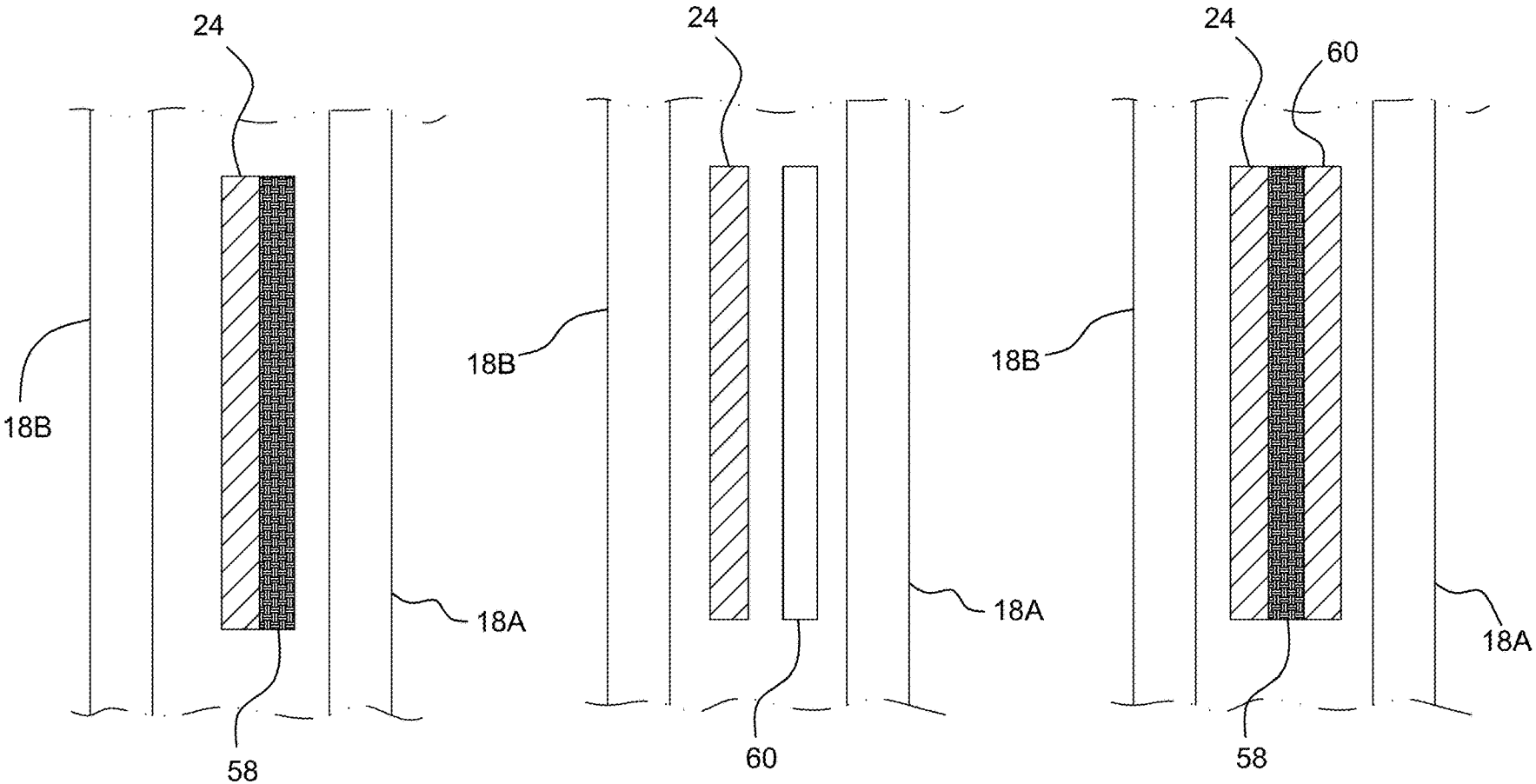
FIGS. 8A-8C schematically show three respective embodiments of one of the guiding jackets of the shell-and-tube heat exchanger according to the present invention.

In FIGS. 8A-8C three respective embodiments of the inner guiding jacket 24 are schematically shown. More specifically, in FIG. 8A the inner guiding jacket 24 is provided with an insulating layer 58 on at least part of the surface thereof, preferably the internal surface thereof, i.e. the surface facing the U-tubes first legs 18A surrounded by said inner guiding jacket 24. Thus, the internal surface of the inner guiding jacket 24 is the surface facing the first portion 18A of each U-shaped exchanging tube 18 surrounded by said inner guiding jacket 24. In FIG. 8B the inner guiding jacket 24 is provided with a double wall, i.e. with its own first wall and a second wall 60. The first wall and the second wall 60 are arranged at a distance from each other. The inner guiding jacket is arranged with its own first wall facing outwardly and with the second internal wall 60 facing the U-tubes first legs 18A surrounded by said inner guiding jacket 24, forming a gap in between the two walls where the hot medium flow, in particular continuous hot medium flow, is prevented. Thus, the inner guiding jacket 24 may be provided with a first wall facing outwardly and with a second internal wall 60 facing the first portion 18A of each U-shaped exchanging tube 18 surrounded by the inner guiding jacket 24. In FIG. 8C the inner guiding jacket 24 is provided both with the insulating layer 58 and the second wall 60 in a "sandwich" configuration, i.e. with the insulating layer 58 interposed between the first wall of the inner guiding jacket 24 and the second wall 60 thereof. Thus, the inner guiding jacket 24 may be provided both with an insulating layer 58 on at least part of the surface thereof and with a first wall and a second wall 60, wherein said insulating layer 58 is interposed between said first wall and said second wall 60, i.e. in a "sandwich" configuration. Further, the inner guiding jacket 24 may be provided both with an insulating layer 58 on at least part of the internal surface thereof, and with a first wall facing outwardly and a second internal wall 60 facing said first portion 18A of each U-shaped exchanging tube 18 surrounded by said inner guiding jacket 24, wherein said insulating layer 58 is interposed between said first outer wall and said second internal wall 60, i.e. in a "sandwich" configuration. These three alternative basic embodiments of the inner guiding jacket 24 can reduce or eliminate possible heat transfer from hot medium to cooling medium due to conduction or radiation through the walls of the inner guiding jacket 24.

Figure 9:
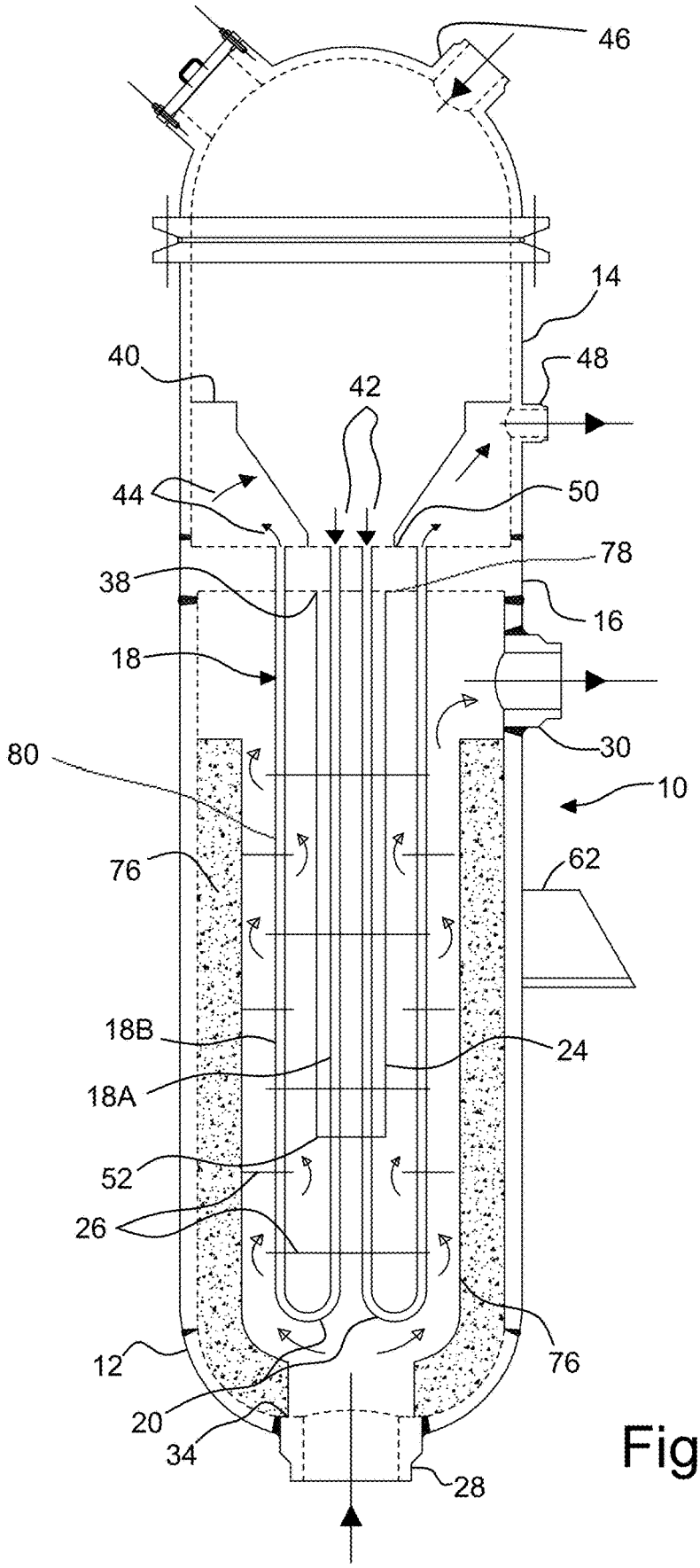
FIG. 9 schematically shows the shell-and-tube heat exchanger of FIGS. 1 and 2, provided with a different layout of its internal components.
Figure 10:
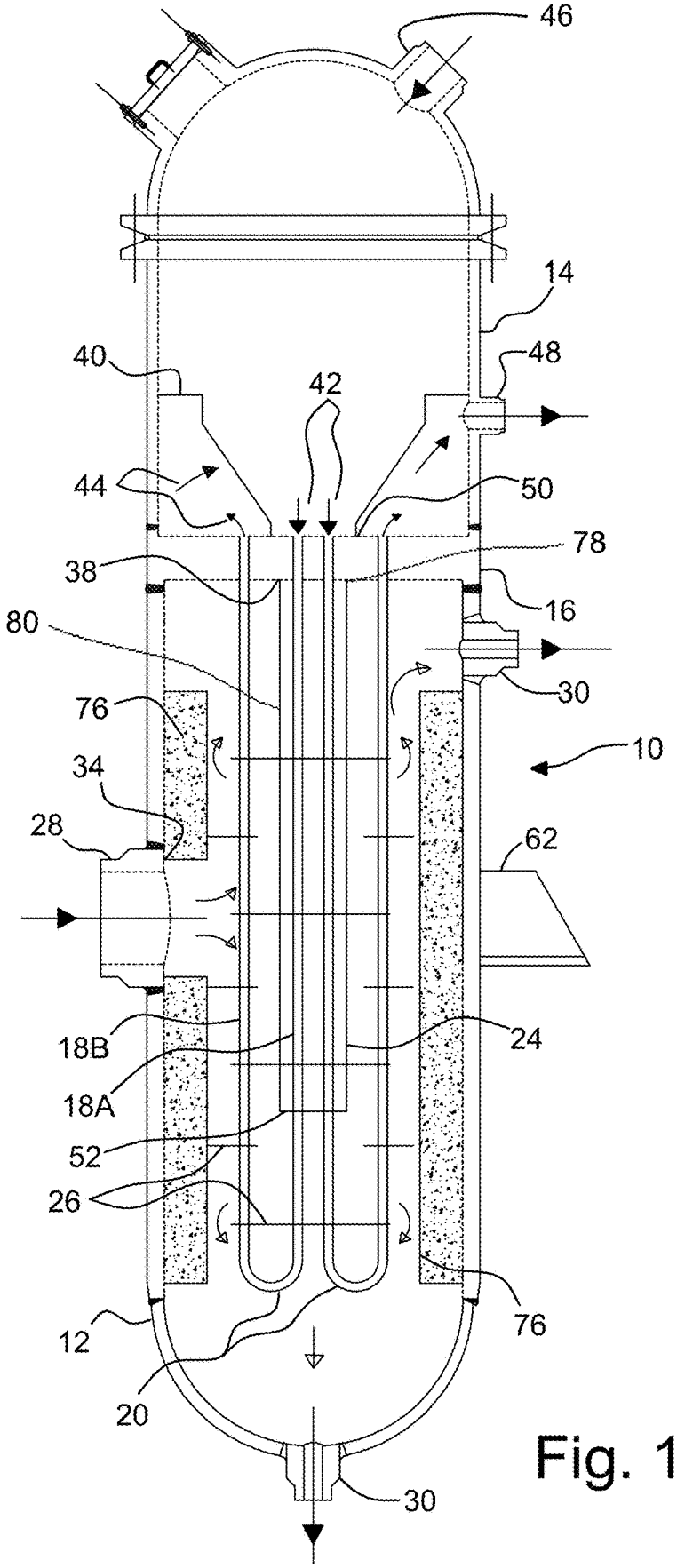
FIG. 10 schematically shows the shell-and-tube heat exchanger of FIGS. 3 and 4, provided with a different layout of its internal components.

In FIGS. 9 and 10 two respective alternative versions of the shell-and-tube heat exchangers of FIGS. 1 to 4 are shown. The difference consist in the fact that the outer guiding jacket 22 and the gap 32 are replaced by at least a layer 76 of an insulating material (refractory) that extends along the major longitudinal axis of the first pressure chamber 12. The layer 76 of an insulating material surrounds both a length portion, preferably most length, of the tube bundle and a length portion, preferably most length, of the inner guiding jacket 24. The layer 76 of an insulating material may surround a major length portion of the tube bundle. The layer 76 of an insulating material may surround a major length portion, of the inner guiding jacket 24. The layer 76 of an insulating material thus protects the first pressure chamber 12 from hot medium. The first pressure chamber 12 may thus contain at least a layer 76 of an insulating material extending along the major longitudinal axis of said first pressure chamber 12, said at least a layer 76 of an insulating material surrounding both a length portion of the tube bundle and a length portion of the inner guiding jacket 24.

The first fluid flowing into the first pressure chamber 12, that is the shell-side of the heat exchanger 10, may be a hot medium, whereas the second fluid flowing into said second pressure chamber 14 and said U-shaped exchanging tubes 18 of the tube bundle, that is the tube-side of the heat exchanger 10, may be a cooling medium.

The first fluid and the second fluid are typically not contacted according to a pure counter-current flows configuration.

Finally, all the embodiments of the heat exchanger 10 can be provided with structural supports 62 and other equipment, like manholes and instruments nozzles, that are not included in the scope of protection of the present invention. According to one aspect, the present invention relates to a method of operating a shell-and-tube heat exchanger 10 having a cylindrical geometry and comprising a first pressure chamber 12 and a second pressure chamber 14 connected to a common tube-sheet 16 on opposite sides, wherein the first pressure chamber 12 is provided with at least an inlet nozzle 28 and with at least an outlet nozzle 30, wherein the second pressure chamber 14 is provided with at least a first nozzle 46 and with at least a second nozzle 48, wherein the tube-sheet 16 is connected to a tube bundle housed in the first pressure chamber 12 and comprising a plurality of U-shaped exchanging tubes 18, wherein each U-shaped exchanging tube 18 is provided with a first portion 18A and with a second portion 18B, wherein the first portion 18A and the second portion 18B of each U-shaped exchanging tube 18 are hydraulically connected by a U-bend 20, wherein the first pressure chamber 12 contains at least one inner guiding jacket 24 having a cylindrical or pseudo-cylindrical geometry and extending along the major longitudinal axis of said first pressure chamber 12, said inner guiding jacket 24 surrounding said first portion 18A of each U-shaped exchanging tube 18 for at least part of the respective length of said first portion 18A, said inner guiding jacket 24 being sealingly connected, at a first end 78 thereof, to the tube-sheet 16 by first connection means 38, said inner guiding jacket 24 being open at a second end 52 thereof, the method comprising:

inletting a first fluid through the inlet nozzle 28 of the first pressure chamber 12, inletting a second fluid through the first nozzle 46 or the second nozzle 48 of the second pressure chamber 14, flowing the second fluid through said plurality of U-shaped exchanging tubes 18 to indirectly perform heat exchange with the first fluid, outletting the first fluid through the outlet nozzle 30 of the first pressure chamber 12, outletting the second fluid through the second nozzle 48 or the first nozzle 46, respectively, of the second pressure chamber 14, whereby the inner guiding jacket 24 creates an at least partly stagnant zone within the inner guiding jacket 24 preventing the first fluid flow across said first portion 18A of each U-shaped exchanging tube 18, therefore preventing, or reducing, the heat transfer from the first fluid to the second fluid in said first portion 18A of each U-shaped exchanging tube 18.

The shell-and-tube heat exchanger of the method may be a shell-and-tube heat exchanger as defined above and may include any of the features, versions and embodiments described above. For example, the inner guiding jacket 24 may comprise a non-perforated envelope surface 80 extending from the first end 78 to the second end 52 of the inner guiding jacket 24.

In the method, the first fluid may be guided across a portion of the tube bundle before contacting the tube-sheet 16. The first fluid may be guided across at least a portion of the second legs 18B of the tube bundle before contacting the tube-sheet 16. Thus, the first fluid may be guided such that a portion of heat is exchanged between the first fluid and the second fluid before the first fluid contacts the tube-sheet 16. The first fluid may be admitted into the first pressure chamber 12 in a point so that the first fluid flows towards the tube-sheet 16 by exchanging at least a portion of heat with the second fluid.

In the method, the first fluid flowing into the first pressure chamber 12, that is the shell-side of the heat exchanger 10, may be a hot medium, whereas the second fluid flowing into said second pressure chamber 14 and said U-shaped exchanging tubes 18 of the tube bundle, that is the tube-side of the heat exchanger 10, may be a cooling medium. In other words, the first fluid inlet into the first pressure chamber 12 may be a hot medium, whereas the second fluid inlet into said second pressure chamber 14 and flowing through said U-shaped exchanging tubes 18 of the tube bundle may be a cooling medium.

In the method, the first fluid and the second fluid are typically not contacted according to a pure counter-current flows configuration.

It is thus seen that the shell-and-tube heat exchanger as well as the method of operating a shell-and-tube heat exchanger according to the present invention achieves the previously outlined objects.

The shell-and-tube heat exchanger as well as the method of the present invention thus conceived is susceptible in any case of numerous modifications and variants, all falling within the same inventive concept; in addition, all the details can be substituted by technically equivalent elements. In practice, the materials used, as well as the shapes and size, can be of any type according to the technical requirements.

The scope of protection of the invention is therefore defined by the enclosed claims.

The invention claimed is:

1. Shell-and-tube heat exchanger having a cylindrical geometry and comprising a first pressure chamber and a second pressure chamber connected to a common tube-sheet on opposite sides, wherein the first pressure chamber is provided with at least an inlet nozzle for inletting a first fluid and with at least an outlet nozzle for outletting the first fluid, wherein the second pressure chamber is provided with at least a first nozzle for inletting or outletting a second fluid and with at least a second nozzle for outletting or inletting, respectively, the second fluid, wherein the tube-sheet is connected to a tube bundle housed in the first pressure chamber and comprising a plurality of U-shaped exchanging tubes through which the second fluid flows to indirectly perform heat exchange with the first fluid, wherein each U-shaped exchanging tube is provided with a first portion and with a second portion, wherein the first portion and the second portion of each U-shaped exchanging tube are hydraulically connected by a U-bend, wherein the first pressure chamber contains at least one inner guiding jacket having a cylindrical or pseudo-cylindrical geometry and extending along the major longitudinal axis of said first pressure chamber, said inner guiding jacket surrounding said first portion of each U-shaped exchanging tube for at least part of the respective length of said first portion, said inner guiding jacket being sealingly connected, at a first end thereof, to the tube-sheet by first connection means, said inner guiding jacket being open at a second end thereof, thereby creating an at least partly stagnant zone within the inner guiding jacket preventing the first fluid flow across said first portion of each U-shaped exchanging tube, therefore preventing, or reducing, the heat transfer from the first fluid to the second fluid in said first portion of each U-shaped exchanging tube.

2. Shell-and-tube heat exchanger according to claim 1, wherein the inner guiding jacket comprises a non-perforated envelope surface extending from the first end to the second end of the inner guiding jacket.

3. Shell-and-tube heat exchanger according to claim 1, wherein the shell-and-tube heat exchanger has a one pass configuration over the tube bundle on the shell side, preferably the shell-and-tube heat exchanger has a two passes configuration on the tube side.

4. Shell-and-tube heat exchanger according to claim 1, wherein the inlet nozzle of the first pressure chamber is arranged at a distance from the tube-sheet such that the first fluid is guided across a portion of the tube bundle before contacting the tube-sheet.

5. Shell-and-tube heat exchanger according to claim 1, wherein the first pressure chamber also contains at least one outer guiding jacket having a cylindrical or pseudo-cylindrical geometry and extending along the major longitudinal axis of said first pressure chamber, said outer guiding jacket surrounding both a length portion of the tube bundle and a length portion of the inner guiding jacket.

6. Shell-and-tube heat exchanger according to claim 5, wherein said outer guiding jacket and the first pressure chamber form a gap in between, said gap being in communication with the first fluid outlet nozzle.

7. Shell-and-tube heat exchanger according to claim 5, wherein said outer guiding jacket, at a first end thereof which is facing away from the tube-sheet, is in communication with the first fluid inlet nozzle by means of a connection conduit, whereas said outer guiding jacket, at a second end thereof which is facing the tube-sheet, has an opening that is in communication with said gap.

8. Shell-and-tube heat exchanger according to claim 5, wherein said outer guiding jacket, at a first end thereof which is facing away from the tube-sheet, is provided with a first opening that is in communication with said gap, whereas said outer guiding jacket, at a second end thereof which is facing the tube-sheet, has a second opening that is in communication with said gap, wherein said outer guiding jacket is in communication with the first fluid inlet nozzle by means of a connection conduit in a point located in between said first opening and said second opening.

9. Shell-and-tube heat exchanger according to claim 1, wherein the U-bends of the U-shaped exchanging tubes are surrounded by a terminal guiding jacket housed in the first pressure chamber, whereby flow of the first fluid across said U-bends is prevented.

10. Shell-and-tube heat exchanger according to claim 1, wherein the inner guiding jacket is provided with an insulating layer on at least part of the surface thereof.

11. Shell-and-tube heat exchanger according to claim 1, wherein the inner guiding jacket is provided with a first wall and a second internal wall arranged at a distance from each other.

12. Shell-and-tube heat exchanger according to claim 1, wherein the second pressure chamber is provided with a second pressure chamber guiding jacket that separates said second pressure chamber into a first section and a second section, wherein said second pressure chamber guiding jacket is connected to the tube-sheet or to one of said first portion or said second portion of each U-shaped exchanging tube by second connection means.

13. Shell-and-tube heat exchanger according to claim 12, wherein said first section and said second section are concentrically arranged in said second pressure chamber, wherein said first section is in fluid communication with said first portion of each U-shaped exchanging tube and said second section is in communication with said second portion of each U-shaped exchanging tube.

14. Shell-and-tube heat exchanger according to claim 1, wherein the U-shaped exchanging tubes have a layout of concentric type, wherein the first portions of said U-shaped exchanging tubes are arranged in a circular central portion of the tube-sheet and wherein the second portions of said U-shaped exchanging tubes are arranged in a circular peripheral portion of said tube-sheet surrounding said circular central portion.

15. Method of operating a shell-and-tube heat exchanger having a cylindrical geometry and comprising a first pressure chamber and a second pressure chamber connected to a common tube-sheet on opposite sides, wherein the first pressure chamber is provided with at least an inlet nozzle and with at least an outlet nozzle, wherein the second pressure chamber is provided with at least a first nozzle and with at least a second nozzle, wherein the tube-sheet is connected to a tube bundle housed in the first pressure chamber and comprising a plurality of U-shaped exchanging tubes, wherein each U-shaped exchanging tube is provided with a first portion and with a second portion, wherein the first portion and the second portion of each U-shaped exchanging tube are hydraulically connected by a U-bend, wherein the first pressure chamber contains at least one inner guiding jacket having a cylindrical or pseudo-cylindrical geometry and extending along the major longitudinal axis of said first pressure chamber, said inner guiding jacket surrounding said first portion of each U-shaped exchanging tube for at least part of the respective length of said first portion, said inner guiding jacket being sealingly connected, at a first end thereof, to the tube-sheet by first connection means, said inner guiding jacket being open at a second end thereof, the method comprising:

inletting a first fluid through the inlet nozzle of the first pressure chamber, inletting a second fluid through the first nozzle or the second nozzle of the second pressure chamber, flowing the second fluid through said plurality of U-shaped exchanging tubes to indirectly perform heat exchange with the first fluid, outletting the first fluid through the outlet nozzle of the first pressure chamber, outletting the second fluid through the second nozzle or the first nozzle, respectively, of the second pressure chamber, whereby the inner guiding jacket creates an at least partly stagnant zone within the inner guiding jacket preventing the first fluid flow across said first portion of each U-shaped exchanging tube, therefore preventing, or reducing, the heat transfer from the first fluid to the second fluid in said first portion of each U-shaped exchanging tube.

* * * * *